United States Patent [19]

Tsai

[11] Patent Number: 5,057,010

[45] Date of Patent: Oct. 15, 1991

[54] FURNACE FOR HEATING PROCESS FLUID AND METHOD OF OPERATION THEREOF

[76] Inventor: Frank W. Tsai, 1842 Alpine Dr., San Marino, Calif. 91108

[21] Appl. No.: 523,384

[22] Filed: May 15, 1990

[51] Int. Cl.[5] ..... F27D 17/00

[52] U.S. Cl. ..... 432/179; 432/180; 432/181; 432/102; 431/11

[58] Field of Search ..... 432/96–97, 432/99–102, 179–182; 431/11

[56] References Cited

U.S. PATENT DOCUMENTS

| | | | |
|---|---|---|---|
| 2,257,229 | 9/1941 | Drake . | |
| 3,633,886 | 6/1972 | Froberg | 432/179 |
| 3,712,597 | 1/1973 | Waitkus et al. | 432/180 |
| 4,212,850 | 7/1980 | Deussner | 432/102 |
| 4,298,372 | 11/1981 | Stover et al. . | |
| 4,375,235 | 3/1983 | Tsai . | |
| 4,394,122 | 7/1983 | Bueno et al. . | |
| 4,496,316 | 1/1985 | Tsai . | |
| 4,506,726 | 3/1985 | Tsai . | |
| 4,528,012 | 7/1985 | Sturgill | 432/181 |
| 4,599,100 | 7/1986 | Demarest, Jr. . | |
| 4,666,403 | 5/1987 | Smith | 432/181 |
| 4,874,311 | 10/1989 | Gitman . | |
| 4,898,530 | 2/1990 | Wills et al. . | |

*Primary Examiner*—Henry C. Yuen

*Attorney, Agent, or Firm*—William W. Haefliger

[57] ABSTRACT

A method of operating an industrial furnace, the steps that include providing a process heating zone containing heat exchange tubing for flowing process fluid through the zone; providing first and second fuel combustion zones, and first and second heat regeneration zones; during a first time interval flowing a first stream of air through the first regeneration zone to be preheated therein, flowing the preheated air stream to the first combustion zone to support combustion of fuel therein producing a flame and hot combustion gases, transferring heat from the flame and the hot gases to the heat exchange tubing in the process heating zone, and then flowing the hot gases to the second heat regeneration zone for extracting heat from the gases at the second regeneration zone; and during a second time interval flowing a second stream of air through the second regeneration zone to be preheated therein, flowing the second preheated air stream to the second combustion zone to support combustion of fuel therein producing hot combustion gases, transferring heat from the hot gases to the heat exchange tubing in the process heating zone, and then flowing the hot gases to the first heat regeneration zone for extracting heat from the gases at the first regeneration zone; and repeating the air flow steps, alternately.

14 Claims, 8 Drawing Sheets

FRONT ELEVATION VIEW

TOP PLAN VIEW

BURNER DETAILS

BURNER DETAIL - FIRING

BURNER DETAIL - EXHAUSTING

COIL & BURNER ARRANGEMENTS
B = BURNER C = COIL

FRONT VIEW END VIEW TOP VIEW FRONT VIEW END VIEW

SINGLE ROW WALL COIL-SINGLE FIRING

DOUBLE ROW WALL COIL-SINGLE FIRING

SINGLE CENTER COIL-DOUBLE FIRING

MULTI FIRING-MULTI COIL

CONVENTIONAL FEED EFFLUENT EXCHANGERS
(3 IN SERIES)

FEED-EFFLUENT EXCHANGER

FURNACE FOR HEATING PROCESS FLUID AND METHOD OF OPERATION THEREOF

BACKGROUND OF THE INVENTION

This invention relates generally to furnaces for supplying heat to processing units used in the petroleum refining, chemical processing and other areas; and more particularly the invention concerns an improved, less complex and less expensive furnace having only one section, i.e., combining into one section the functions of the prior two section (radiant and convection) furnace.

Industrial furnaces are involved in most of the above mentioned industrial processes. Such a furnace is normally required to supply heat to the process. It can be direct or indirect heating. For direct heating, a furnace is required; and for indirect heating, a heat transfer medium is used, such as steam, Dowtherm, etc. The heating of a heat-transfer medium also requires a furnace, such as a steam boiler.

A furnace generally has two sections or boxes, namely, a radiant section and a convection section. Both sections contain heating coils where heat is transferred from the hot gases produced by combustion of fuel with air into the process fluid (petroleum, petroleum derivative, chemicals, etc.)

In the radiant section, fuel is burned with combustion air, and heat is transferred by radiation. In the early days when the cost of fuel was less expensive and more abundant, the furnace had only the radiant section. Later, when the cost of fuel became more expensive, the thermal efficiency of the furnace was of great concern. The convection section was added to the radiant section, thus improved the thermal efficiency of the furnace. In such a furnace, the hot flue gas (products of combustion) that leaves the radiant section at elevated temperature enters the convection section where heat is transferred by convection from the hot flue gas to the process. Such a furnace, as currently used and required, is complex and expensive, requiring multiple sets of tubes and supports, therefor for both the radiant and convection sections, and repair and replacement of such tubes, is a highly costly operation.

SUMMARY OF THE INVENTION

It is a major object of the present invention to provide improved furnace equipment, as well as techniques and methods of handling air flow and combustion gases that overcome the above problems and difficulties. In effect, the furnace is simplified and "fine-tuned" to provide heat-recapture and reuse for high efficiency, eliminating need for the convection section assembly previously believed to be required.

Basically, the apparatus of the invention is embodied in the following:

a) means forming first, second, third, fourth, and fifth zones connected in flow passing sequence, b) a primary heat regeneration means at the first zone, and a secondary heat regeneration means at the fifth zone, c) a primary fuel burner means at the second zone and a secondary fuel burner means at the fourth zone, d) tubing means in the third zone for passing process fluid to be heated by hot combustion gases flowing in that zone, e) and means for flowing one stream of air through the first zone to be preheated therein and into the second zone for combustion with fuel supplied via the primary burner means, thereby to produce a flame and hot combustion gases that flow through the third zone to the fifth zone for heat transfer to process fluid, and/or heating the secondary heat regeneration means, all during a first time interval, and for flowing another stream of air through the fifth zone to be preheated therein, and into the fourth zone for combustion with fuel supplied via the secondary burner, means, thereby to produce a flame and hot combustion gases that flow through the third zone to the first zone for heat transfer to process fluid, and for heating the primary heat regeneration means, all during a second time interval, f) and control means for controlling said flow of the air stream on a cyclically repeated basis.

As will appear, nitrogen-oxides ($NO_x$) removing catalyst beds may be located in flow passing sequence with the heat regeneration means, and their gas inlet temperatures may be controlled as by bypassing hot gases directly and controllably to those beds.

It is another object to provide means for controllably by-passing at least some flowing air around at least one of the primary and secondary heat regeneration means for direct introduction into at least one of the second and fourth zones.

Yet another object is to provide means to controllably inject $H_2O$ into the second and fourth zones; and the $O_2$ level in the air flowing to the first and fifth zones may be reduced as by supplying exhaust gas to such air in diluting relation.

The basic method of the invention includes:

a) providing a process heating zone containing heat exchange tubing for flowing process fluid through the zone, b) providing first and second fuel combustion zones, and first and second heat regeneration zones, c) during a first time interval flowing a first stream of air through the first regeneration zone to be preheated therein, flowing the preheated air stream to the first combustion zone to support combustion of fuel therein producing hot combustion gases, transferring heat from the hot gases to the heat exchange tubing in the process heating zone, and then flowing the hot gases to the second heat regeneration zone for extracting heat from the gases at the second regeneration zone, d) and during a second time interval flowing a second stream of air through the second regeneration zone to be preheated therein, flowing the second preheated air stream to the second combustion zone to support combustion of fuel therein producing a flame and hot combustion gases, transferring heat from the flame and the hot gases to said heat exchange tubing in the process heating zone, and then flowing the hot gases to the first heat regeneration zone for extracting heat from the gases at the first regeneration zone, e) and repeating the c) and d) steps, alternately.

These and other objects and advantages of the invention, as well as the details of an illustrative embodiment, will be more fully understood from the following specification and drawings, in which:

DRAWING DESCRIPTION

DETAILED DESCRIPTION

Figure 1:
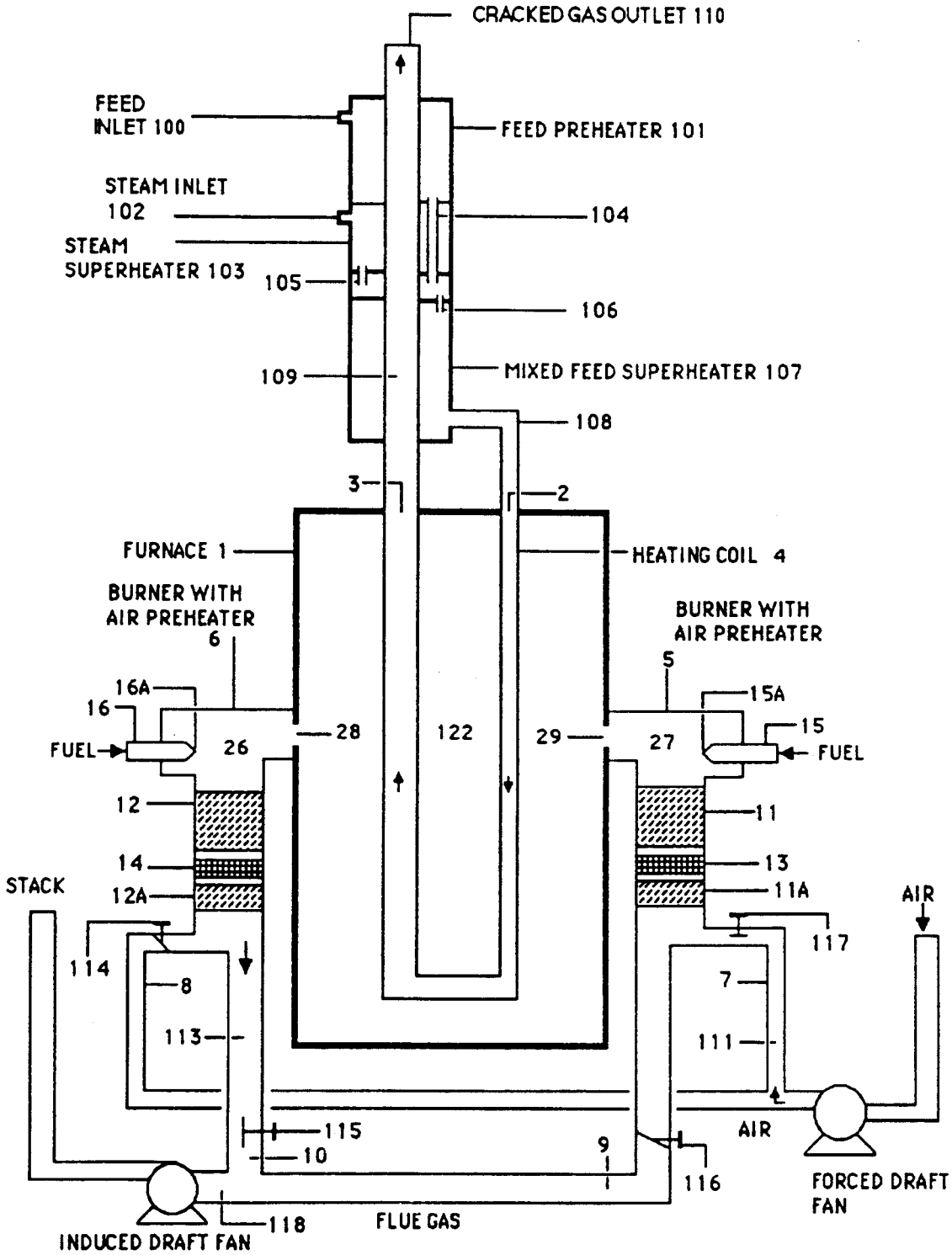
FIG. 1 shows the furnace and an associated process.
Figure 2:
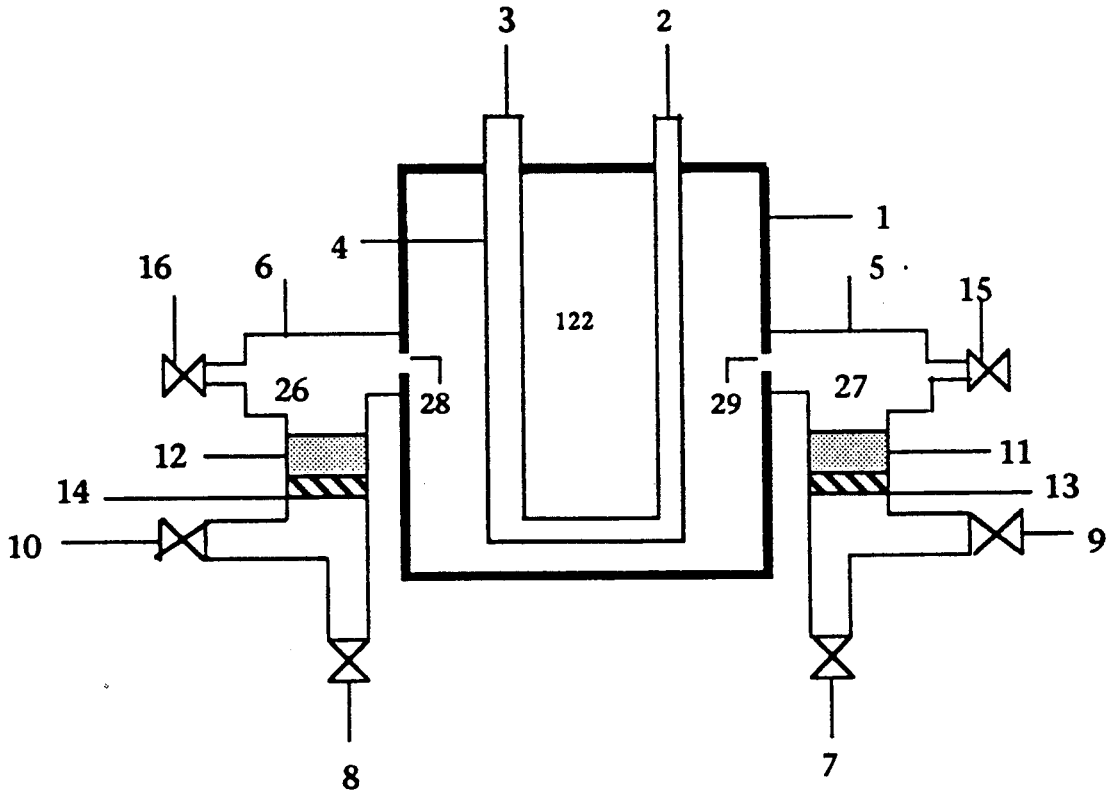
FIG. 2 is a front elevation showing the furnace, schematically.
Figure 3:
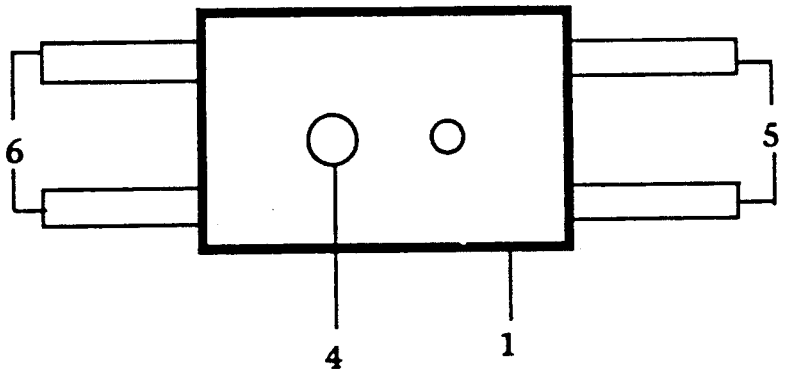
FIG. 3 is a top plan view of the FIG. 1 furnace.
Figure 4:
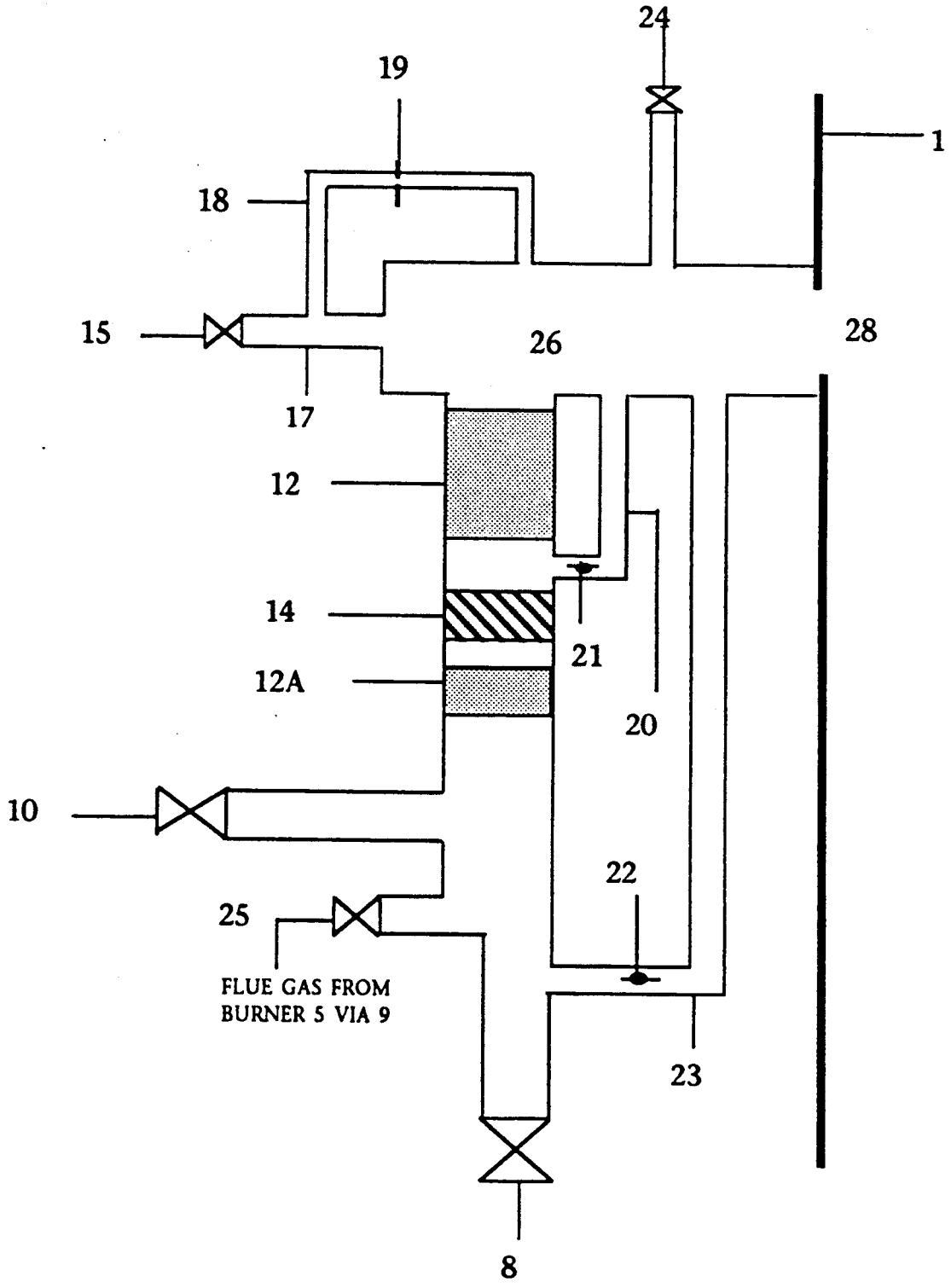
FIG. 4 is an elevation showing, schematically, further details of one side of the furnace.
Figure 5:
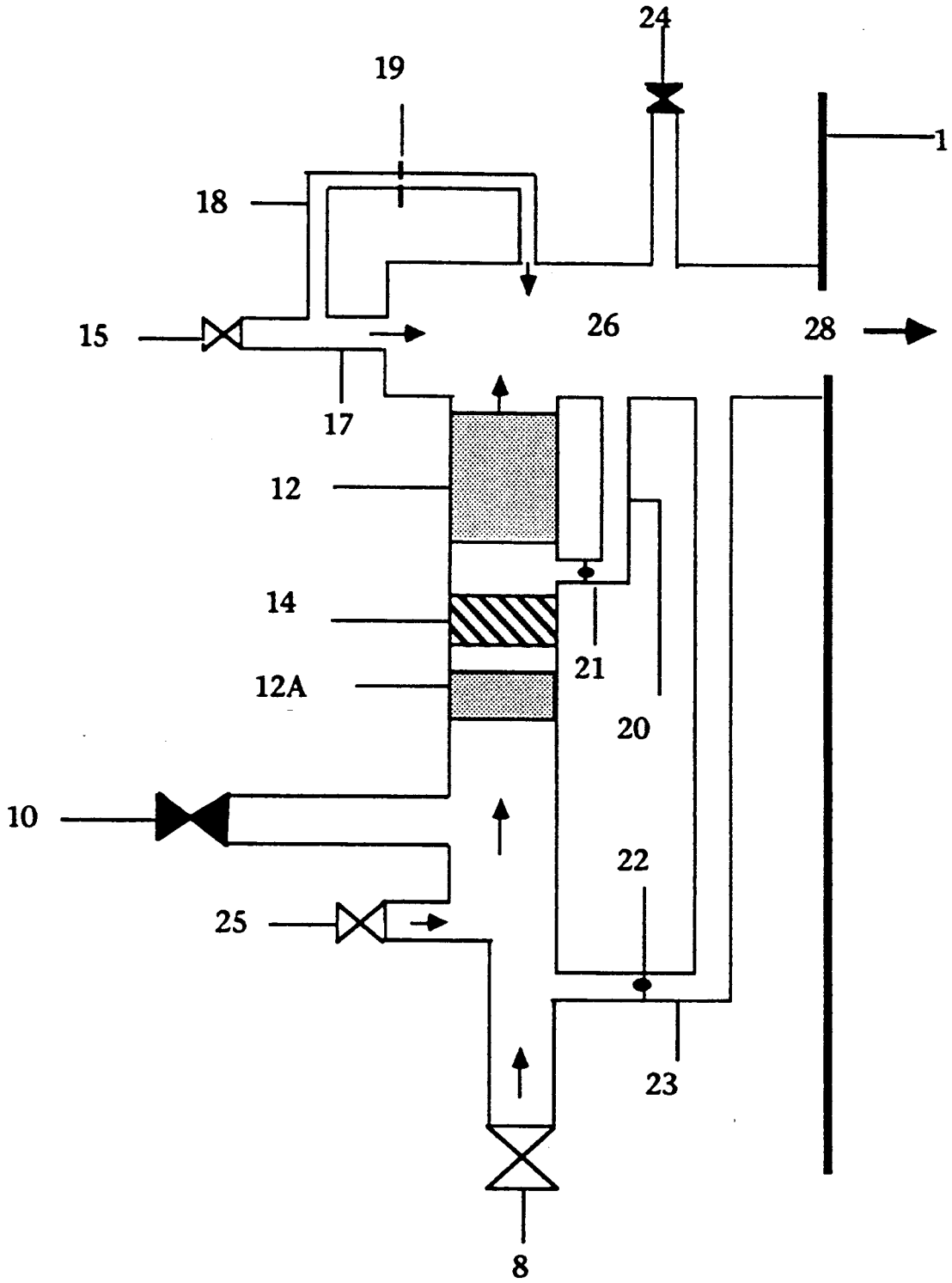
FIG. 5 is an elevation like FIG. 4 showing operation during burner firing.

As seen in FIGS. 1–5, the new furnace has only one furnace box 1 where fuel is fired and the heat is transferred from the combustion of fuel to the process. A process liquid stream enters the furnace at the process inlet 2. The process stream is heated up in the heating coil 4 inside the furnace. The heated process stream exits the furnace at the process outlet 3. A multi-pass heating coil can be used to increase the furnace capacity. That coil can be oriented to have ducts that extend vertically or horizontally. FIG. 1 shows elements at 100–110 associated with a hydrocarbon reforming or pyrolysis, as indicated.

The combustion of fuel is accomplished by a pair of burners 5 and 6 operating at opposite sides of the furnace. Only one burner is firing at a given time, i.e., the two burners are fired alternately. The normal length of the firing cycle varies from 10 seconds and up.

When burner 5 is firing, ambient air from the forced draft fan enters from the combustion air inlet 7, and it flows, via duct 111, through the $NO_x$ catalyst bed 13 (seen in the FIG. 2 version) and the combustion air preheater 11. The ambient air is heated by the hot combustion air preheater 11. The flue gas outlet 9 is closed at this time. The fuel, entering from the fuel inlet 15 and burner 15*a*, is burned with the entering hot combustion air in the combustion chamber 27. The ambient air is heated to about 2,000° F., for example, in the regenerator 11. The flame and the hot gaseous products of combustion (for example at above 2,800° F.) enter the furnace box 1 at the flue gas inlet 29. Heat is transferred from the flame and the hot flue gas to the heating coil 4 where the process stream is being heated. The flue gas leaves the furnace through the flue gas outlet 28 and enters the combustion chamber 26 of burner 6, which is not operating at this time, fuel inlet 16 being closed.

When burner 5 is firing, chamber 26 is exhausting. The hot flue gas is cooled down from about 2,400° F. by flow through and heating up of the combustion air preheater or regenerator 12. $NO_x$ reduction is accomplished in the $NO_x$ catalyst bed 14 through which the flue gas flows. The cooled flue gas flows through duct 113 and leaves from the opened flue gas outlet 10 and duct 118 to the induced draft fan and stack into the atmosphere at about 300° F. The combustion air preheater inlet 8 is closed at this time. See valves 114–117.

After the first time-cycle is ended, burner 6 is fired up, and the hot flue gas will exhaust via burner chamber 5. This involves air inlet at 8, flow through 12 for preheating, combustion in 26, and flow through zone 122 for heating process fluid in 4, exit at 29, and flow through the preheater/regenerator 11 to exit at 9, as cooled gas, for a second time-cycle. A typical cycle of 20 seconds is shown below:

| | | Time, seconds | | | |
|---|---|---|---|---|---|
| | | 0 | 20 | 40 | 60 |
| Burner | 5 | firing | exhaust | firing | exhaust |
| Fuel Inlet | 15 | open | closed | open | closed |
| Combustion Air Preheater | 11 | reject | absorb | reject | absorb |
| $NO_x$ Catalyst Bed | 13 | idle | reaction | idle | reaction |
| Combustion Air Inlet | 7 | open | closed | open | closed |
| Flue Gas Outlet | 9 | closed | open | closed | open |
| Burner | 6 | exhaust | firing | exhaust | firing |
| Fuel Inlet | 16 | closed | open | closed | open |
| Combustion Air Preheater | 12 | absorb | reject | absorb | reject |
| $NO_x$ Catalyst Bed | 14 | reaction | idle | reaction | idle |
| Combustion Air Inlet | 8 | closed | open | closed | open |
| Flue Gas Oulet | 10 | open | closed | open | closed |

The burner details are shown in FIGS. 2–5.

The burners are installed in pairs. They can be a single pair or multi pairs. They can be fired either horizontally or vertically. The most common arrangement of burners and tubular coils are discussed below.

Figure 6:
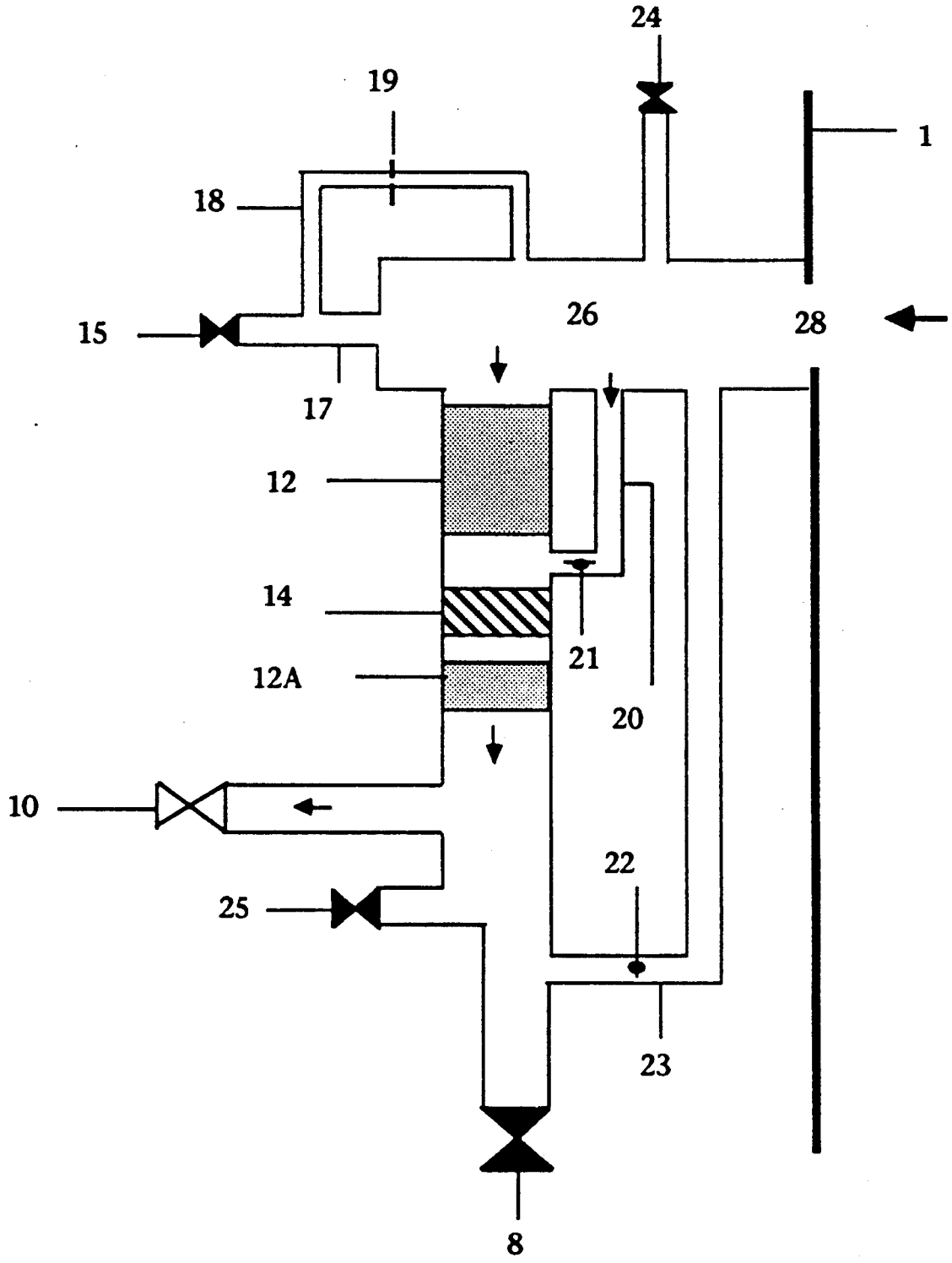
FIG. 6 is an elevation like FIG. 4 showing operation during non-firing of such burner at that side of the furnace.

In order to reduce the $NO_x$ in the flue gas, several abatement techniques are used:

A $NO_x$ reduction, catalyst beds 13 and 14 are used to convert the $NO_x$ into nitrogen. For higher conversion, this catalyst usually operates above the temperature which is higher than the flue gas exit temperature. This requires the catalyst bed to be located somewhere within the combustion air preheater. Two sections of the combustion air preheaters 12 and 12*a* are employed in FIGS. 4, 5 and 6, and similar divided preheaters may be used at 11 and 11*a*.

A damper 21 in a flue gas by-pass duct 20 controls the inlet temperature to the catalyst bed, to maintain and control the high temperature.

The formation of $NO_x$ in the combustion process increases with the flame temperature. The flame temperature can be reduced by:

1. Increasing the number of fuel injectors used in the combustion chamber. The fuel enters the burner at 15. A portion of the fuel may be diverted away from the main fuel injection.
2. Increasing the number of combustion air injectors into the combustion chamber. The main combustion air is preheated in the combustion air preheater 12 and 12*a*. A portion of the combustion air can be directly passed or fed via duct 23 to the combustion chamber 26. Its flow rate is controlled by the damper 22.
3. Steam/water injection at 24 can also be used to lower the flame temperature.

Reducing the oxygen in the combustion air will decrease the $NO_x$ formation. In this regard, the flue gas leaving the non-firing burner ma be used to dilute the incoming combustion air to the firing burner. This dilution flue gas enters at 25, for example from burner 5, as via 9.

The process liquid is heated in single pass or multipass heating coils. The coil layout can be either horizontal or vertical. It can also be a single row or multi rows arrangement. Typical arrangements are shown below:

| Firing Direction | Burner Row* | Coil Location | Coil Row | Coil Position |
|---|---|---|---|---|
| horizontal | one | wall | two | horizontal |
| horizontal | one | wall | two | vertical |
| vertical | one | wall | two | horizontal |
| vertical | one | wall | two | vertical |
| horizontal | two | center | one | horizontal |
| horizontal | two | center | one | vertical |
| vertical | two | center | one | horizontal |
| vertical | two | center | one | vertical |
| horizontal | multi | center | multi | horizontal |
| horizontal | multi | center | multi | vertical |
| vertical | multi | center | multi | horizontal |
| vertical | multi | center | multi | vertical |

*In each burner row there are one or more pairs of burners per level, and there can be more than one level of burners.

Figure 7:
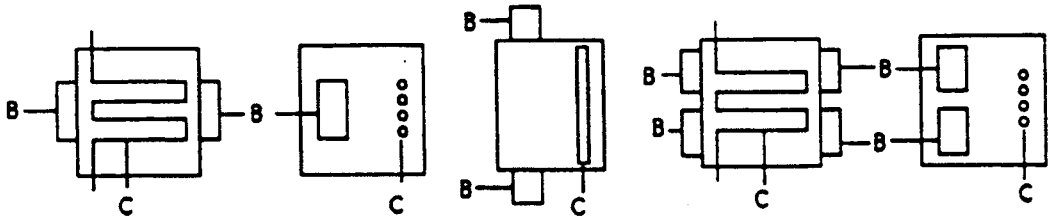
FIG. 7 is a schematic view of various coil and burner arrangements, as labeled.
Figure 7:
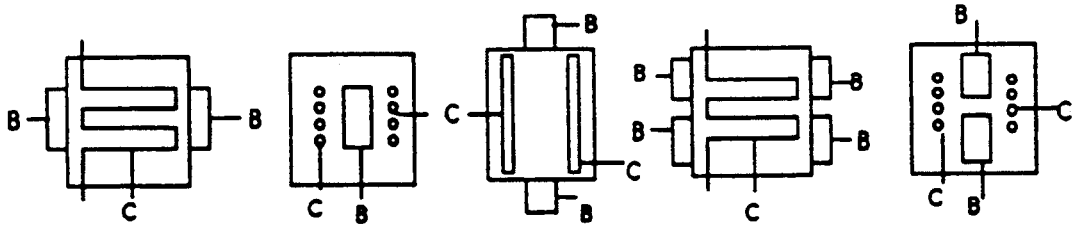
Figure 7:
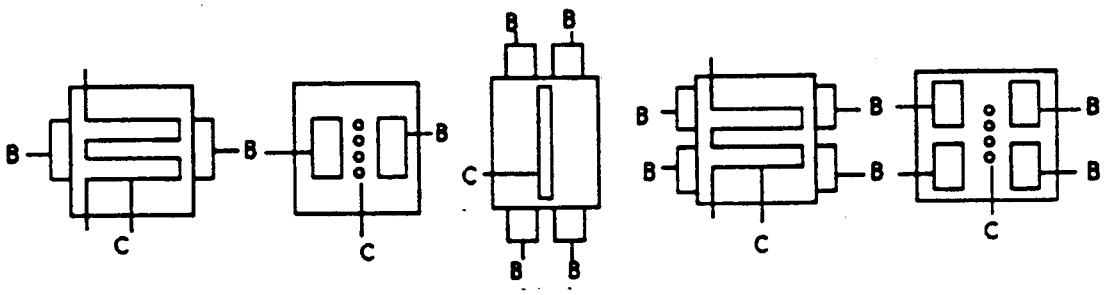
Figure 7:
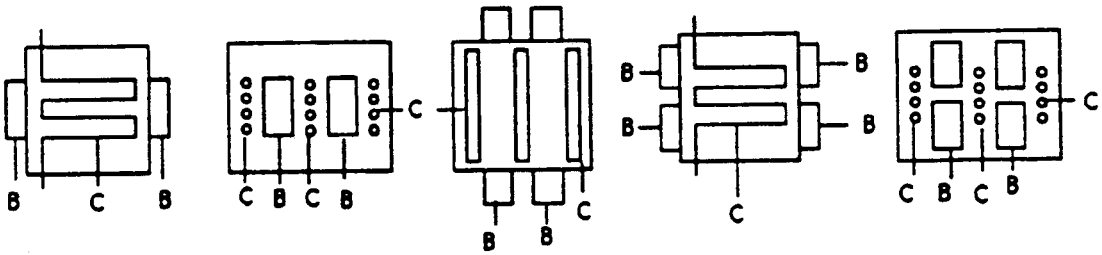

These arrangements can be shown in FIG. 7.

The furnace may have a cylindrical box. The burner arrangement is typically as follows:

| Box Position | Firing Position |
|---|---|
| Vertical | Vertical |
| Horizontal | Horizontal |

The fuel and preheated combustion air are burned in the combustion chamber. The flame and the combustion products are diluted with cold ambient air to reduce the flame temperature which lowers the formation of $NO_x$. It also reduces the impingement of the flame onto the tubular coil. Steam may also be used instead of the cold ambient air to lower the flame temperature in the combustion chamber.

The outlet nozzle of the combustion chamber is shaped in such a way that the combustion products leaving will be defined, such as a rectangular or round shape.

Fired tubes can also be used to transfer heat to liquid in a process. The fired tube can be straight or U-shaped, with a burner at each end firing alternatively. The fired tubes can be installed in a vessel or tank. It can also be installed in a heat exchanger which can be a double pipe or a conventional shell and tube type There are many technical and economical benefits of a furnace with a single box. These are:

1. It is less costly.
2. It is easy to construct.
3. It is simple to operate and control.
4. It has high thermal efficiency.
5. It is used to supply heat to the process. No steam or other mediums are involved.
6. Burners produce minimum of $NO_x$.

In the above, combustion air preheaters or regenerators 11 and 12 are porous, and may consist of nuggets of porous ceramic material. Catalyst in beds 13 and 14 may consist of vanadium and titanium oxides.

Figure 8:
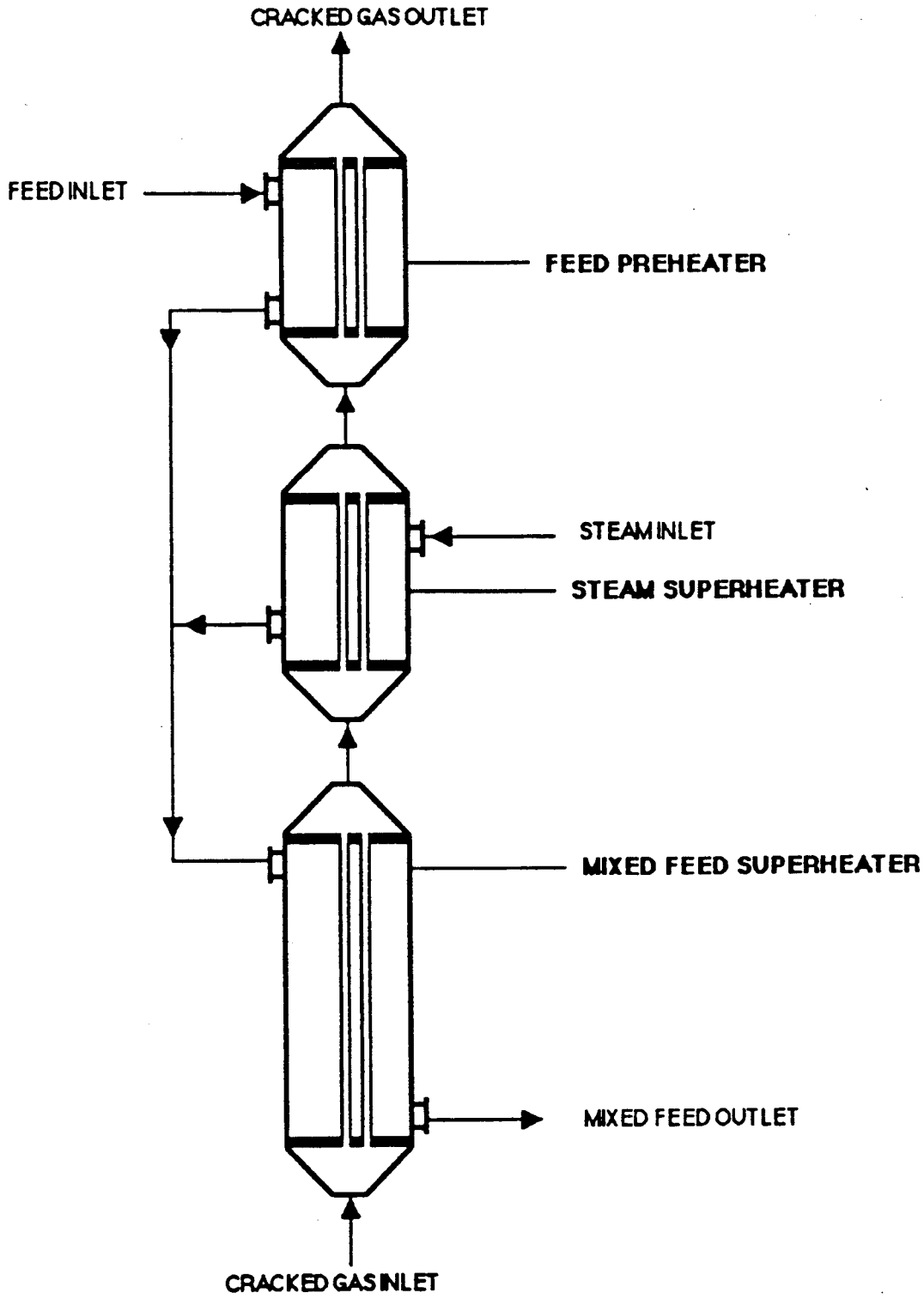
FIG. 8 is a section through a known 3-feed effluent exchanger.

FIG. 8 shows a prior three chamber, 3-feed effluent heat exchanger apparatus, appropriately labeled.

Figure 9:
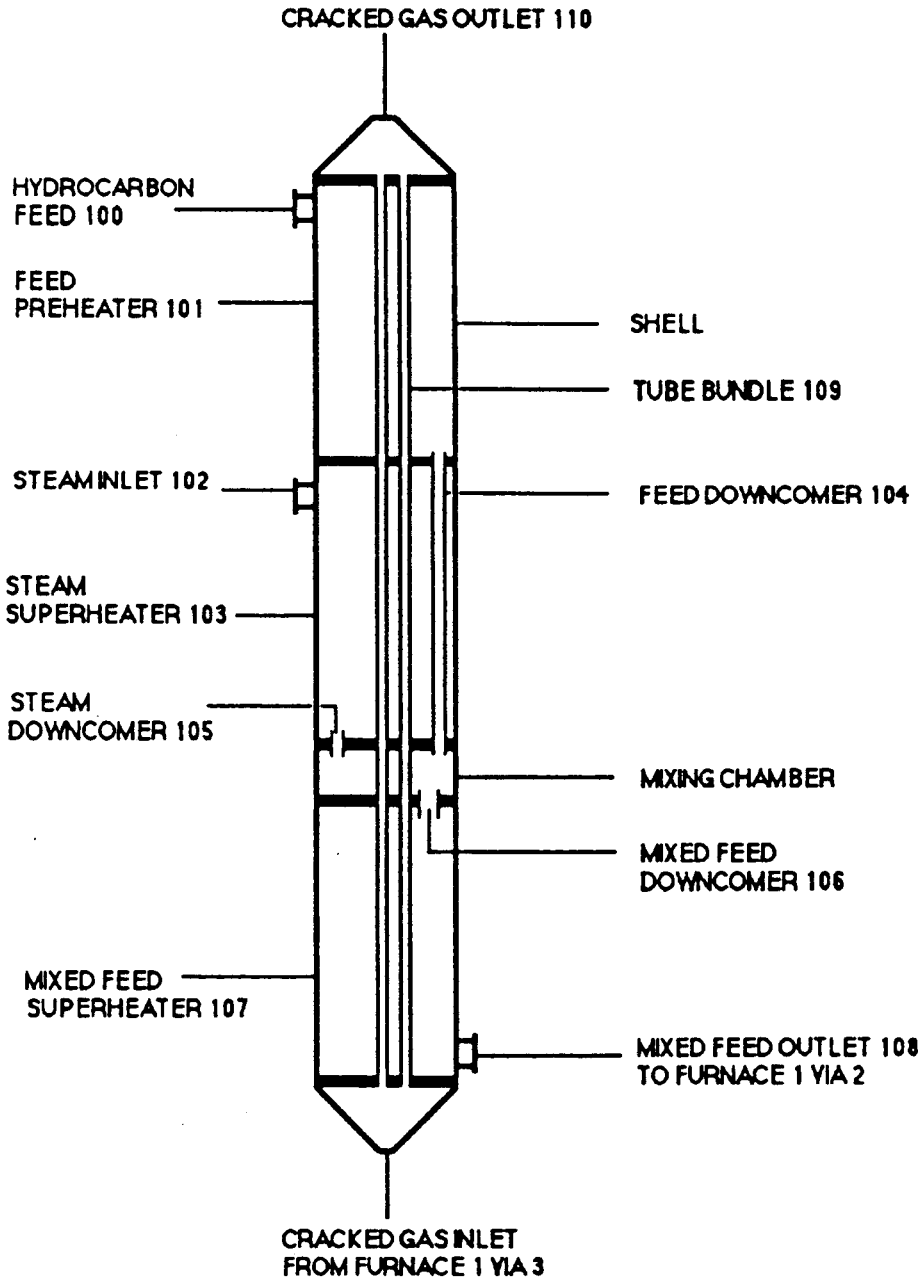
FIG. 9 is a section through a feed/effluent exchanger usable in conjunction with the invention.

FIG. 9 shows an improved, single chamber, feed/effluent heat exchanger apparatus usable in conjunction with the invention, i.e., FIG. 9 is a more detailed view of the exchanger shown above the furnace 1 in FIG. 1.

There are at least three compartments in the feed/effluent exchanger. The exchanger is a shell and tube type. The hot medium flows through the tube side 109 in a single pass, whereas the shell side has four compartments: feed preheater 101, steam superheater 103, a mixing chamber as shown, and mixed feed superheater 107. The feed and steam are the two cold mediums to be heated.

The shell side outlet compartment is for feed heating. The feed is preheated in the cold end to minimize cracking of feed in the absence of dilution steam.

The preheated feed flows to the mixing chamber, via a feed downcomer 104. The superheated steam flows downward into the mixing chamber via a steam downcomer 105. The two streams are mixed in the mixing chamber. The mixed feed leaves the mixing chamber and flows into the mixed feed preheater 10 through a mixed feed downcomer 106. The mixed feed is heated to the crossover temperature before it enters the pyrolysis coils in the radiant section.

The benefits of the three compartment heat exchanger over three separate exchangers are:

1. It is compact.
2. It is low cost.
3. It is easy to clean and maintain.
4. It saves space.
5. It has very low pressure drop through the tube side.

I claim:

1. In an industrial furnace, the combination comprising:

(a) means forming first, second, third, fourth, and fifth zones connected in flow passing sequence, (b) a primary heat regeneration means at first zone, and a secondary heat regeneration means at the fifth zone, (c) a primary fuel burner means at the second zone and a secondary fuel burner means at the fourth zone, (d) tubing means in the third zone for passing process fluid to be heated by hot combustion gases flowing in that zone, the third zone located generally between said second and fourth zones, (e) and means for flowing one stream of air through said first zone to be preheated therein and into said second zone for combustion with fuel supplied via said primary burner means, thereby to produce hot combustion gases that flow through the third zone and fourth zone to said fifth zone for transfer of heat to process fluid and for heating said secondary heat regeneration means, all during a first time interval, and for flowing another stream of air through said fifth zone to be preheated therein, and into said fourth zone for combustion with fuel supplied via said secondary burner means, thereby to produce hot combustion gases that flow through the third zone and second zone to said first zone for transfer of heat to the process fluid and for heating said primary heat regeneration means, all during a second time interval, (f) and control means for controlling said air flow on a cyclically repeated basis, (g) and including $NO_x$ catalyst bed means located in flow passing sequence with at least one of said primary and secondary heat regeneration means.

2. The combination of claim 1 wherein said $NO_x$ catalyst bed means includes a primary bed means between two sections of said primary heat regeneration means, and a secondary bed means between two sections of said secondary heat regeneration means.

3. The combination of claim 1 including means for controllably by-passing hot combustion gases directly to said $NO_x$ bed for controlling the inlet temperature thereof.

4. The combination., of claim 2 including by-pass ducts and dampers therein for controllably bypassing hot combustion gases directly to said primary and secondary $NO_x$ beds for controlling the inlet temperature thereof.

5. The combination of claim 3 including means for controllably by-passing at least some flowing air around each of the primary and secondary heat regeneration means and each of the two $NO_x$ catalyst beds for direct introduction into the second and fourth zones.

6. The combination of claim 5 wherein said last named means includes ducts, dampers therein, and damper position control actuators.

7. In an industrial furnace, the combination comprising:

(a) means forming first, second, third, fourth, and fifth zones connected in flow passing sequence, (b) a primary heat regeneration means at the first zone, and a secondary heat regeneration means at the fifth zone, (c) a primary fuel burner means at the second zone and a secondary fuel burner means at the fourth zone, (d) tubing means in the third zone for passing process fluid to be heated by hot combustion gases flowing in that zone, the third zone located midway between said second and fourth zones, (e) and means for flowing one stream of air through said first zone to be preheated therein and into said second zone for combustion with fuel supplied via said primary burner means, thereby to produce hot combustion gases that flow through the third zone and fourth zone to said fifth zone for transfer of heat to process fluid and for heating said secondary heat regeneration means, all during a first time interval, and for flowing another stream of air through said fifth zone to be preheated therein, and into said fourth zone for combustion with fuel supplied via said secondary burner means, thereby to produce hot combustion gases that flow through the third zone and second zone to said first zone for transfer of heat to the process fluid and for heating said primary heat regeneration means, all during a second time interval, (f) control means for controlling said air flow on a cyclically repeated basis, (g) and including hydrocarbon and steam feed means for said tubing means in the third zone, and means to conduct reformed or pyrolysed hydrocarbons from said tubing means.

8. The combination of claim 7 including means for controllably by-passing at least some flowing air around at least one of the primary and secondary heat regeneration means for direct introduction into at least one of the second and fourth zones.

9. The combination of claim 7 including means to controllably inject $H_2O$ into said second and fourth zones.

10. The combination of claim 7 including means to reduce the $O_2$ level in the air flowing to at least one of said first and fifth zones.

11. The combination of claim 10 wherein said last named means includes ducting operatively connected between the first and fifth zones to supply gas exhausting from one of the first and fifth zones to the other of said zones to dilute the air flowing to said other zone.

12. The combination of claim 7 wherein said process tubing in said third zone extends in one of the following configurations:

i) is elongated vertically ii) is elongated horizontally

13. The combination of claim 7 including an inlet and gas exhaust valving in ducting associated with said first and fifth zones for venting exhaust gas when incoming air flow is blocked, and for allowing incoming air flow when exhaust gas is absent.

14. The combination of claim 10 including hydrocarbon and steam feed means includes an elongated outer shell containing in vertical downward succession:

i) a feed preheater first chamber having a fluid hydrocarbon feed inlet, ii) a steam superheater second chamber having a steam inlet, iii) a mixing third chamber having inlets from said first and second chambers, iv) a mixed feed superheater fourth chamber having an inlet from said third chamber, and an outlet to deliver a mixed hydrocarbon and steam feed to said tubing means, v) and ducting extending through said fourth, third, second, and first chambers to conduct reformed or pyrolysed hydrocarbons from said tubing means to an outlet from said shell, vi) there being baffle means between said successive chambers.

* * * * *